US006156979A

United States Patent [19]

Pioch

[11] Patent Number: 6,156,979

[45] Date of Patent: Dec. 5, 2000

[54] BUSHING DEVICE AND BUSHING ASSEMBLY INCLUDING IT

[75] Inventor: Olivier Pioch, Nice, France

[73] Assignee: Pioch S.A., Carros Cedex, France

[21] Appl. No.: 09/145,461

[22] Filed: Sep. 2, 1998

[30] Foreign Application Priority Data

Sep. 3, 1997 [FR] France ..... 97 10968

[51] Int. Cl.[7] ..... H01B 17/26

[52] U.S. Cl. ..... 174/152 G; 174/152 R; 174/153 R; 174/209; 174/167

[58] Field of Search ..... 174/152 R, 152 G, 174/151, 153 R, 167, 177, 178, 179, 195, 209

[56] References Cited

U.S. PATENT DOCUMENTS

| | | | |
|---|---|---|---|
| 3,803,523 | 4/1974 | Farmer et al. | 336/90 |
| 3,856,983 | 12/1974 | Fisher et al. | 174/151 |
| 3,979,549 | 9/1976 | Wilkinson | 428/450 |
| 4,965,407 | 10/1990 | Hamm | 174/31 R |
| 5,623,125 | 4/1997 | Pioch | 174/152 R |
| 5,808,536 | 9/1998 | Sandlin, Jr. et al. | 336/107 |
| 5,885,680 | 3/1999 | Levillian et al. | 428/60 |
| 5,902,963 | 5/1999 | Chappaz et al. | 174/167 |
| 5,952,617 | 9/1999 | Bergstrom | 174/152 R |

FOREIGN PATENT DOCUMENTS

| | | |
|---|---|---|
| 0 446 404 A1 | 9/1991 | European Pat. Off. . |
| 0 678 879 A1 | 10/1995 | European Pat. Off. . |

*Primary Examiner*—Kristine Kincaid
*Assistant Examiner*—W. David Walkenhorst
*Attorney, Agent, or Firm*—Jacobson, Price, Holman & Stern, PLLC

[57] ABSTRACT

The invention concerns a bushing device (12) designed to be fitted through a hole in a wall including a body (20) and a cover (18) each adapted to be disposed on one side of the wall and rod and connection (14, 16) for connecting the body (20) and the cover (18) to grip said wall between them, the body (20) and the cover (18) including aligned passages (22, 47) adapted to receive a conductive rod (14). The cover (18) includes an inner core (44) delimiting the passage (47) for receiving the rod (14) and an outer sheath (46) covering the lateral wall of the inner core (44), the inner core (44) and the outer sheath (46) being made of different materials.

20 Claims, 3 Drawing Sheets

BUSHING DEVICE AND BUSHING ASSEMBLY INCLUDING IT

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention concerns a bushing device designed to be fitted through a hole in a wall, of the type having on the one hand a body and a cover each designed to be disposed on one side of the wall and on the other hand means for connecting the body and the cover to grip said wall between them, the body and the cover having aligned passages designed to receive a conductive rod.

The invention further concerns a bushing assembly of the type including a bushing device and a conductive rod which is received in the aligned passages of the body and the cover, passes completely through the body and the cover and has a connection for an electrical cable at one end.

Bushing devices designed to be fixed to a low-voltage output rod of a transformer are already known in themselves. A component of this kind has an electrical function consisting of feeding the output current of the transformer from the output windings inside the transformer casing to external electrical circuits with perfect electrical insulation between the conductive rod and the casing. To fulfill this electrical function in complete safety for many years, a bushing device must also be mechanically strong in order to withstand high operating temperatures (up to 250° C.), vibration and static loads due to the mounting or to the assembly of the device.

Because of this, prior art bushing devices generally include a body made of ceramic or of a material hardened by heat of the epoxy resin type in the form of a skirt having an annular area passing through a hole formed in the wall of a transformer and an annular cover situated on the opposite side of the wall relative to the body, said body cooperating with the cover to grip the wall of the transformer to form a strong mechanical assembly which electrically insulates the conductive rod. The cohesion of the assembly is assured by fixing nuts screwed onto the ends of the output rod.

One such device is described in application EP-A-0.678.879 filed in the name of Applicant, for example.

Although they may fulfill their insulation function satisfactorily, the prior art devices are not highly resistant to external chemical and mechanical stresses.

The aim of the invention is to provide a solution to this problem by proposing a bushing device and a bushing assembly including it achieving satisfactory performance in terms of insulation and resistance to external chemical and mechanical attack.

BRIEF SUMMARY OF THE INVENTION

To this end, the invention consists of a bushing device of the aforementioned type characterized in that the cover includes an inner core delimiting the passage for receiving the rod and an outer sheath covering the lateral wall of the inner core, the inner core and the outer sheath being made of different materials.

In particular embodiments, the bushing device can have one or more of the following features:

- the inner core is made from a plastics material such as PBT or polyamide,
- the outer sheath is made of an elastomer, in particular silicone or neoprene,
- the outer sheath is made of a material that is more deformable than that forming the inner core,
- the outer sheath covers essentially all of the area of the inner core after installation of the bushing device,
- the outer sheath has on the outside at least one peripheral flange substantially centered along the axis of the rod and locally enlarging the transverse dimension of the cover, and
- the inner core is nested substantially without play inside the outer sheath.

The invention also consists of a bushing assembly of the type aforementioned characterized in that said connection includes a lug provided with cable fixing means and the rod carries on the one hand a fixed abutment and on the other hand an axial mobile bush, said lug being attached to one of said abutments and to said bush, said abutment and said bush having inside and outside lateral surfaces adapted to cooperate with a wedging effect along the axis of the rod, said inside lateral surface capping at least partially said external lateral surface, the rod including means for clamping the bush against said abutment in the direction of the axis of the rod.

In particular embodiments, the bushing assembly can have one or more of the following features:

- said facing lateral surfaces of said bush and of said abutment are substantially complementary frusto-conical surfaces,
- the inside lateral surface is carried by lips distributed around the periphery of the rod and separated by axial notches,
- said rod is a screwthreaded rod, at least in the portion supporting said abutment,
- said abutment is a ring which is screwthreaded internally over at least a part of its length,
- the material on which the inside lateral surface is defined is harder than the material on which the outside lateral surface is defined,
- said outside lateral surface is carried by said abutment,
- the lug is attached to said abutment and is aligned with said rod, and
- said bush extends the bushing device on the same side as the abutment in the lengthwise direction of the rod and the means for clamping the bush against the abutment are disposed on the rod on the other side of the bushing device.

The invention be will better understood from a reading of the following description given by way of example only and with reference to the drawings.

DETAILED DESCRIPTION OF THE INVENTION

Figure 1:
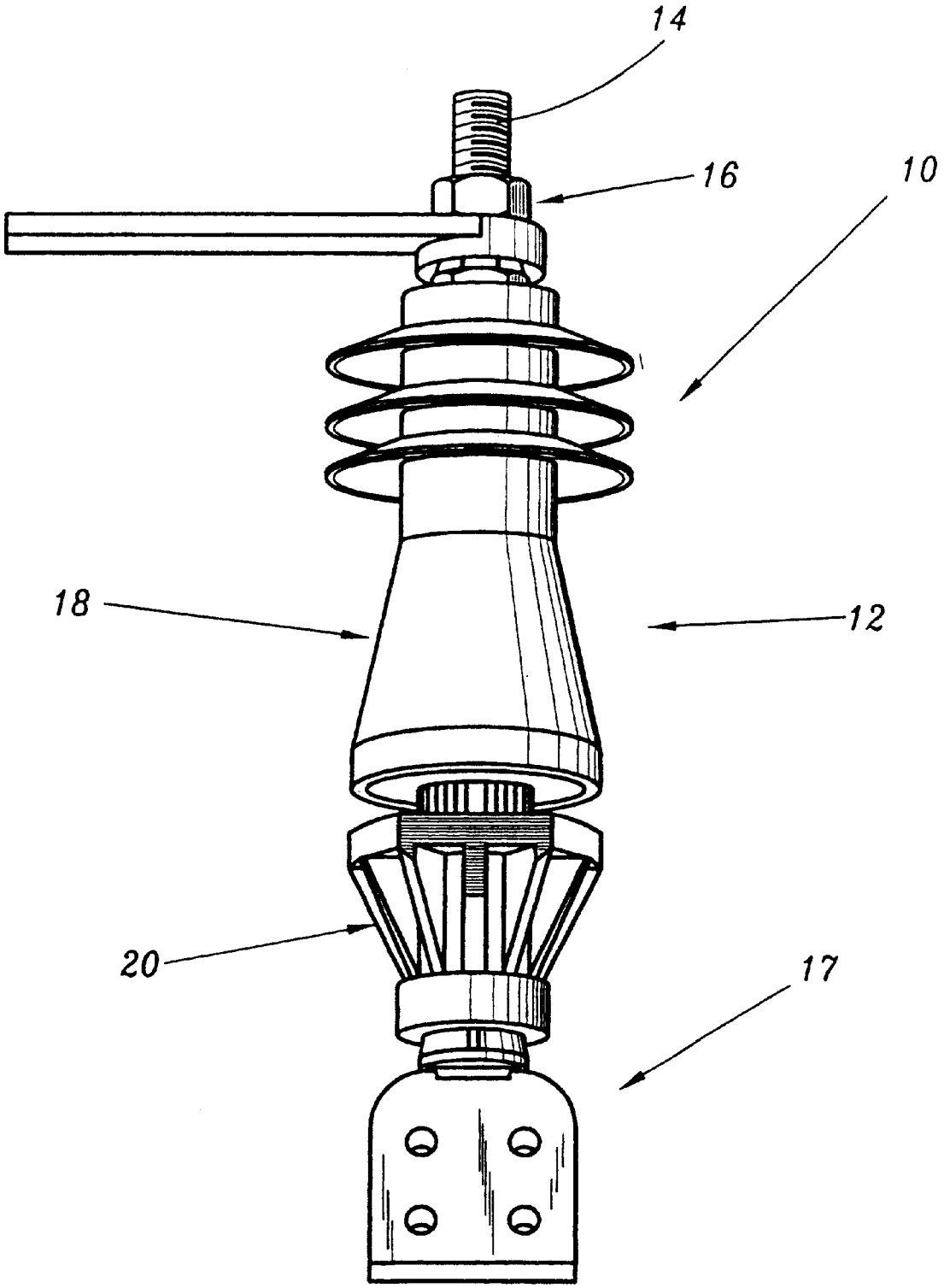
FIG. 1 is a perspective view of a bushing assembly in accordance with the invention.
Figure 3:
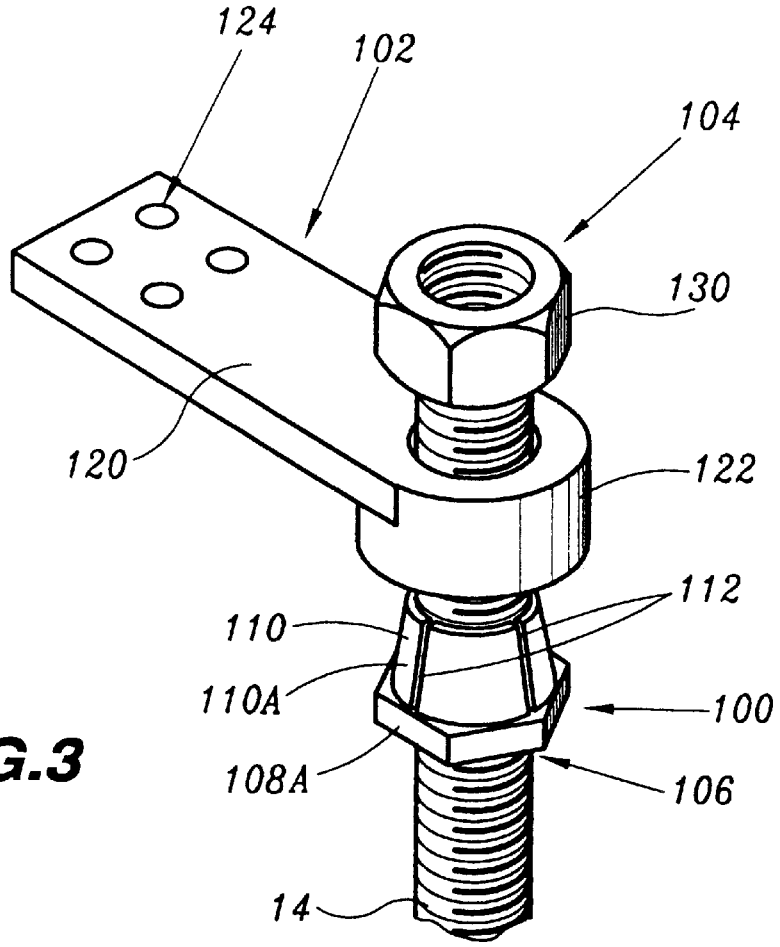
FIG. 3 is a perspective view of the external connection of the bushing device from FIGS. 1 and 2.
Figure 4:
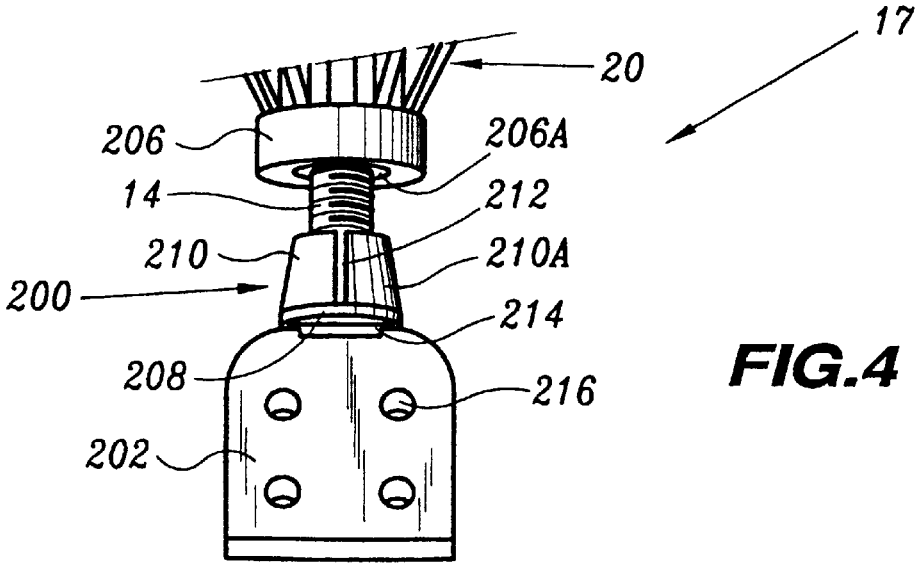
FIG. 4 is a perspective view of the interior connection of the bushing device from FIGS. 1 and 2.

The bushing assembly 10 shown in FIG. 1 includes a bushing device 12 and a conductive screwthreaded rod 14 having an upper connection 16 shown in more detail in FIG. 3 at an outside end and lower connection 17 shown in more detail in FIG. 4 at an inside end.

The bushing device 12 essentially includes a cover 18 and a body 20 through both of which the rod 14 passes completely. The cover 18 and the body 20 are each designed to be disposed on one side of a wall (w), the rod 14 forming means connecting the body and the cover to grip the wall (w) between them.

Figure 2:
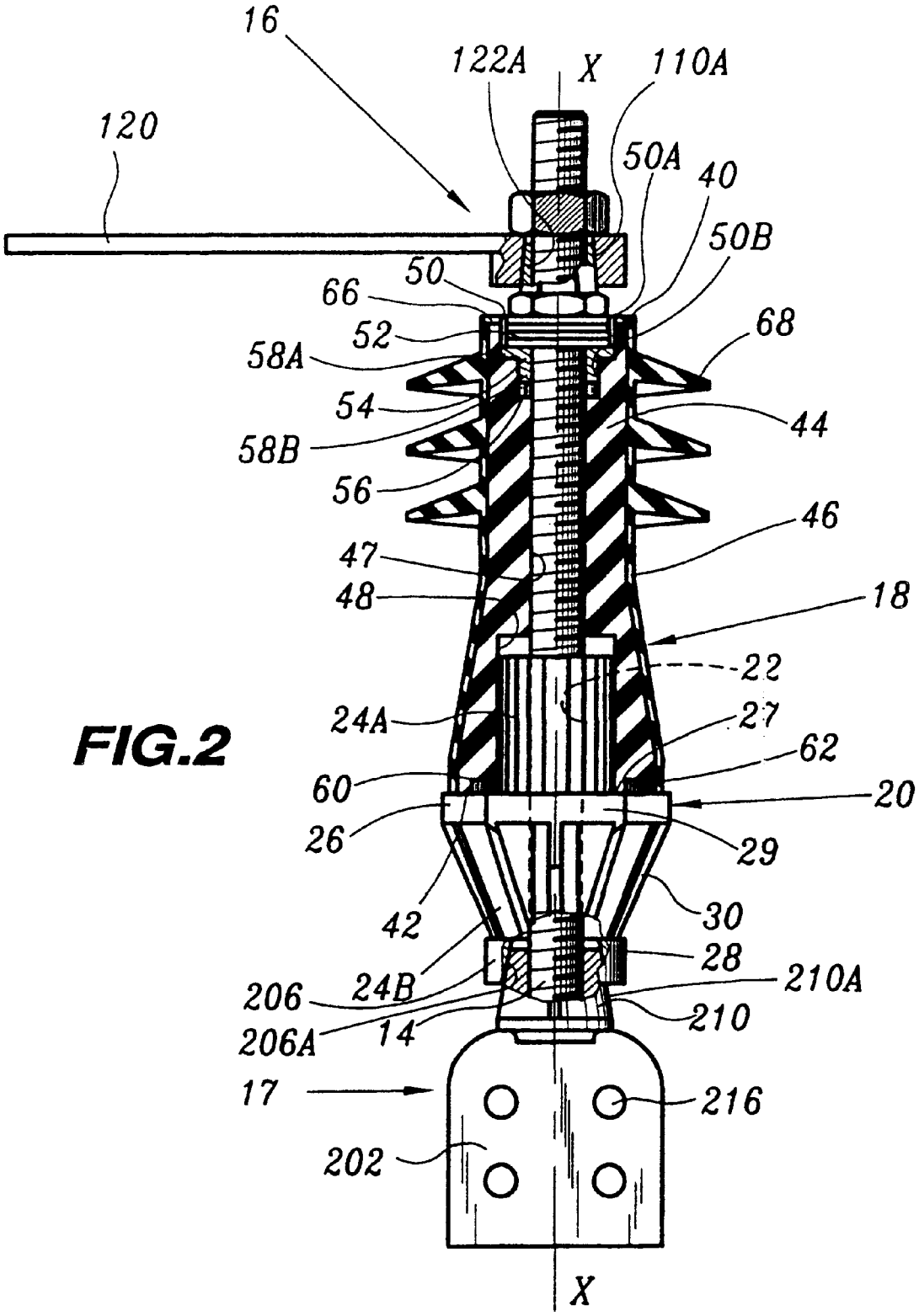
FIG. 2 is an elevation view of the bushing assembly from FIG. 1 showing the cover in longitudinal section.

FIG. 2 shows that the body 20 has symmetry of revolution about axis X—X. It includes an axial passage 22 to receive the rod 14.

The body 20 is in the form of a sleeve having a splined section 24A adapted to pass through the hole in the wall in which the bushing device is installed and to enter a housing in the cover 18. The section 24A is extended by a frustoconical section 24B in one piece with it. They are separated by a rim 26 forming a surface 27 bearing on one face of the wall (w). The section 24B has a lower flange 28 at the other end having an outside diameter less than the diameter of the rim 26.

The rim 26 incorporates two diametrally opposite flats 29 for holding the body 20 in position using an appropriate wrench or by means of an abutment formed on the wall (w).

The rim 26 and the lower flange 28 are connected by a set of triangular reinforcing ribs 30 extending in the axial direction. These ribs are regularly distributed around the periphery of the body.

The cover 18 is of substantially cylindrical shape with a top face 40 and a bottom face 42, the latter being adapted to come into contact with the wall (w) on which the bushing assembly is installed.

In accordance with the invention, the cover 18 includes an inner core 44 and an outer sheath 46 covering the lateral wall of the inner core, the inner core and outer sheath being made of different materials.

The outside lateral wall of the core 44 has a cylindrical shape in an upper part extended towards the bottom face 42 by a frustoconical bottom section widening progressively towards the bottom end.

The core 44 delimits an axial passage 47. In its main part, the diameter of the passage 47 is substantially equal to the outside diameter of the rod 14. At the end opening onto the bottom face 42 the passage 47 incorporates a recess 48 forming an open chamber adapted to receive the splined section 24A of the body. The length of the recess 48 is greater than the length of the splined section 24A.

Near its top face 40 the passage 47 has a cylindrical opening 50 centered on the axis X—X.

The cylindrical opening 50 preferably includes two successive coaxial cylinders 50A and 50B. The first cylinder 50A opening onto the top face 40 has an inside diameter greater than the diameter of the second cylinder 50B extending the first cylinder 50A axially.

The first cylinder 50A is designed to receive washers 52 and the second cylinder 50B is adapted to receive a spacer 54 and a gasket 56.

The spacer 54 is preferably generally cylindrical in shape with a lower flange 58A extending into the lower part of the cylinder 50A and a smaller diameter axial part 58B extending into the second cylinder 50B.

The bottom face 42 of the inner core 44 includes a peripheral grove 60 centered on the axis X—X and receiving an O-ring 62 adapted to be pressed against the wall and thus provide a seal between the latter and the cover 18.

The inner core 44 is advantageously made of a plastics material such as PBT (polybutylene terephtalate) or polyamide.

The sheath 46 is of generally cylindrical shape about the axis X—X. It is formed by a wall having symmetry of revolution and a small constant thickness, in the order of 1 mm to 2 mm.

The profile of the inside surface of the sheath 46 corresponds to the profile of the outside surface of the core 44. Accordingly the sheath 46 includes from its upper end a hollow cylindrical portion having symmetry of revolution extended by a hollow frustoconical portion widening progressively towards the lower end of the sheath.

The upper end of the sheath 46 includes a reentrant rim 66 designed to come into contact with the top surface of the core 44. The rim 66 is delimited internally by a passage whose diameter is substantially the same as the diameter of the washers 52 received in the cylinder 50A.

The outside surface of the sheath 46 includes, in succession, along the length of its cylindrical portion, at least one radial flange 68 in one piece with it. These flanges, of which there are three in FIG. 1, extend all around the periphery of the sheath and so locally increase its diameter.

The outer sheath is advantageously made of an elastomer, in particular of silicone or neoprene. In particular, the outer sheath 46 is made from a material that is more deformable than that forming the inner core 44.

The sheath 46 and the core 44 are made separately and are assembled by nesting the core inside the deformable sheath 46.

FIG. 3 shows in detail the connection 16 at the outside end of the rod 14 on the same side as the cover 18.

This connection essentially includes an abutment 100, a lug 102 for fixing an electrical cable and means 104 for clamping the lug 102 onto the abutment 100.

In the embodiment shown, the abutment 100 is a ring 106 fitted over the screwthreaded rod 14. This ring has an internally screwthreaded portion engaged with the screwthread on the rod. The screwthreaded portion has an externally hexagonal drive section 108 and is extended by a set of axial lips 110, of which there are four, for example, separated by axial notches 112. The inside surface of the lips 110 is initially smooth and cylindrical. The outside surface 110A of the lips delimits a frustoconical surface whose diameter progressively decreases towards the free end of the lips. The abutment 100 is made of copper, for example.

The lug 102 includes a plate 120 extended by a bush 122 fitted onto the screwthreaded rod 14. The plate 120 is perpendicular to the rod 14. It has electrical cable fixing means 124 at its free end. These fixing means include, for example, clips (not shown) tightened by means of screws received in the screwthreaded holes passing through the plate 120.

The bush 122 has an internal frustoconical surface 122A the shape of Erich is substantially complementary to that of the outside frustoconical surface 11OA delimited by the outside surface of the lips 110. The inside diameter of the bush 122 decreases continuously from its end facing the abutment 100 to its end facing the clamping means 104.

The lug 102, and in particular the bush 122, is advantageously made from an electrically conductive material that is harder than the material of the abutment 100. It is made of brass or bronze, for example.

The means 104 for clamping the lug 102 to the abutment 100 are formed by a nut 130 screwed onto the free end of the rod 14, for example.

FIG. 4 shows in detail the connection 17 mounted at the end of the rod 14 on the same side as the body 20.

Like the connection 16 from FIG. 3, this connection essentially includes a fixed abutment 200, a lug 202 for fixing an electrical cable and means for clamping the lug 202 against a bush 206 mobile along the rod 14. In this embodiment the bush 206 is formed by the flange 28.

The clamping means are formed by the internally screwthreaded wing 106 which has six drive flats 108A.

The bush 206 is placed on the axis of the rod 14 at the end of the bushing device 12 on the same side as the abutment 200. Like the bush 122, it has a frustoconical internal lateral surface 206A whose diameter progressively increases towards the open end towards the abutment 200.

The abutment 200 is attached to the end of the rod 14. It has an annular base 208 extended by lips 210 separated along the periphery of the rod 14 by axial notches 212.

Like the abutment 100, in the section defined by the lips 210 the abutment 200 has a frustoconical external lateral surface 210A whose diameter progressively decreases towards the free end of the lips.

The outside face of the base 208 includes a yoke 214 retaining the lug 202. The lug 202 therefore extends the rod 14.

Like the lug 102, the lug 202 carries screwthreaded holes 216 for fixing an electrical cable.

To fit the bushing assembly to a wall the body 20 and in particular its splined portion 24A is put through a hole in the wall. The rod 14 previously fitted with the fixed abutment 200 is then inserted into the passage 22 so that it passes completely through the body 20. The pre-assembled cover 18 is then fitted. Pre-assembly of the cover 18 consists in covering most of the lateral surface of the internal core 44 with the external sheath 46.

The gasket 56, the spacer 54 and the washers 52 are then introduced into the opening 50. The abutment 100 is then screwed to the free end of the rod 14. The abutment 100 is caused to bear on the visible washer 52 so as to press the bottom face 42 of the body fitted with the O-ring 62 onto the wall (w).

Clamping of the abutment 100 causes the lips to engage inside the bush 206. In particular the outside lateral surface 210A is partly capped by the inside lateral surface 206A. The two facing surfaces therefore cooperate because of the clamping action of the abutment 100, assuring axial retention of the abutment relative to the body 20 by virtue of a wedging effect.

The lug 102 and the nut 130 are then fitted to the outside free end of the rod 14. Tightening the nut 130 causes engagement and co-operation of the facing frustoconical surfaces 110A, 122A carried by the abutment 100 and the bush 122.

Clamping causes the lips 110 to deform progressively towards the axis X—X and to be swaged onto the screwthread of the rod 14. Also, the deformation of the lips 110 due to the movement of the bush 122 along the axis of the rod wedges the latter onto the abutment 100.

Obviously the abutment 100 and the bush 122 are then in bearing engagement with each other over all of the surface area of the frustoconical walls in contact. This large contact surface area assures effective wedging and mechanical retention of the lug 102 on the abutment 100. Accordingly, even if the nut 130 is unscrewed, the connection between the lug 102 and the abutment 100 is assured by virtue of a wedging effect. Also, the deformation of the lips 100 on the threaded rod 14 fastens the abutment 100 to the rod and therefore achieves reliable coupling of the ring 100 to the rod.

Similarly, the cooperation of the complementary surfaces of the bush 206 and the abutment 200 assures that in the event of loosening of the abutment 110 the lug 202 remains attached to the bush 206 and the bushing device.

The core 44, which is made from a plastics material having mechanical properties adapted to assure correct retention of the rod, is completely protected from external aggression by the sheath 46. The latter, made from a strong material, is relatively insensitive to external mechanical and chemical attack.

Moreover, the successive flanges 68 create an increase in the length of the surface path defined axially on the surface of the cover, so limiting the propagation of leakage currents to the surface of the bushing device.

In a variant that is not shown the bush 206 is not made in one piece with the body 20. It is in the form of a ring fitted over the rod 14 between the body 20 and the abutment 200. It bears on the body when the abutment 100 is clamped.

The lugs 102 and 202 are plane in the example described here. As an alternative to this, they are curved and have deformations modifying their orientation relative to the axis of the bushing device. Accordingly the rod 102 can extend parallel to the axis of the device.

Moreover, the section of the lugs can be rounded to enable welding or crimping of conductor cables.

What is claimed is:

1. A bushing device (12) designed to be mounted in and extending through a hole in a wall (w), said bushing device being of the type including a body (20) and a cover (18) respectively positionable on opposite sides of the wall (w) and means (14, 16) for connecting the body (20) and the cover (18) to each other to permit gripping said wall (w) between them, the body (20) and the cover (18) including aligned passages (22, 47), a conductive rod (14) positioned in said aligned passages and having an axis, wherein the cover (18) includes an inner core (44) delimiting the passage (47) for receiving the rod(14) and an outer sheath (46) covering the inner core (44), the inner core (44) and the outer sheath (46) being made of different materials.

2. A device according to claim 1 characterized in that the inner core (44) is made from a plastics material.

3. A device according to claim 2 wherein said plastics material is PBT.

4. A device according to claim 2 wherein said plastics material is polyamide.

5. A device according to claim 1 characterized in that the outer sheath (46) is made of an elastomer.

6. A device according to claim 5 wherein said elastomer is silicone.

7. A device according to claim 5 wherein said elastomer is neoprene.

8. A device according to claim 1 characterized in that the outer sheath (46) is made of a material that is more deformable than the material forming the inner core (44).

9. A device according to claim 1 characterized in that the outer sheath (46) covers essentially all of the area of the inner core (44) after installation of the bushing device.

10. A device according to claim 1 characterized in that the outer sheath (46) has on the outside at least one peripheral flange (68) substantially centered along the axis (X—X) of the rod (14) and locally enlarging the transverse dimension of the cover (18).

11. A device according to claim 1 characterized in that the inner core(44) is nested without play inside the outer sheath (46).

12. A bushing assembly according to claim 1 wherein said conductive rod (14) passes through the body (20) and the cover (18) and has at one end portion a first connection (16) for an electrical cable and at another end portion a second connection for another electrical cable characterized in that said first connection (16) includes a first lug (102) provided with cable fixing means and the rod (14) carries on a first fixed abutment (100) and an axial mobile first bush (122) said first lug being attached to said first abutment (100) and to said first bush (122) a second abutment (200) and an axially mobile second bush (206), said second lug being attached to said second abutment (200) and to said second bush (206), said first abutment (100) and said first bush (122) having inside lateral surfaces (122A) and outside lateral surfaces (110A) adapted to cooperate to provide a wedging effect along the axis of said rod (14), said second abutment (200) and said second bush (206) having inside lateral surfaces (206A) and outside lateral surfaces (210A) adapted to cooperate to provide a wedging effect along the axis of the rod (14), side inside lateral surfaces respectively capping at least partially external lateral surfaces (110A, 210A) and further including clamping means (100) for clamping the first bush (122) against the first abutment (100) in the direction of the axis of the rod (14) and second clamping means (104) for clamping the second bush (206) against the second abutment (200) in the direction of the axis of the rod (14).

13. A bushing assembly according to claim 12 characterized in that said facing lateral surfaces of said first bush (122) and of said first abutment (100) are substantially complementary frustoconical surfaces.

14. A bushing assembly according to claim 13 characterized in that the inside lateral surface of said first brush (122A) is carried by lips (110) distributed around the periphery of the rod (14) and separated by axial notches (122).

15. A bushing assembly according to claim 13 characterized in that said rod is a screw threaded rod in the portion supporting said first fixed abutment (100).

16. A bushing assembly according to claim 15 characterized in that said first fixed abutment (100) is a ring which is screw threaded internally.

17. A busing assembly according to claim 12 characterized in that the material on which the inside lateral surfaces (122A, 206A) are defined is harder than the material on which the outside lateral surfaces (110A, 210A) are defined.

18. A busing assembly according to claim 12 characterized in that said outside lateral surfaces (110A, 210A) are respectively carried by said first and second abutments (100, 200).

19. A bushing assembly according to claim 12 characterized in that the second lug (202) is attached to said second abutment (200) and is aligned with said rod (14).

20. A bushing assembly according to claim 12 characterized in that said second bush (206) extends along the bushing device on the same length of rod (14) and the first fixed abutment (100) for clamping the second bush (206) against the first abutment (200) are disposed on the rod (14) on the other side of the bushing device (12).

* * * * *